US009764367B2

(12) United States Patent
Burger et al.

(10) Patent No.: US 9,764,367 B2
(45) Date of Patent: Sep. 19, 2017

(54) WIDTH-ALTERING SYSTEM FOR STRIP-SHAPED ROLLING ROCK

(71) Applicant: PRIMETALS TECHNOLOGIES GERMANY GMBH, Erlangen (DE)

(72) Inventors: Rainer Burger, Nuremberg (DE); Ansgar Grüss, Erlangen (DE); Andreas Jungbauer, Leonding (AT); Robert Linsbod, Linz (AT)

(73) Assignee: PRIMETALS TECHNOLOGIES GERMANY GMBH (DE)

( * ) Notice: Subject to any disclaimer, the term of this patent is extended or adjusted under 35 U.S.C. 154(b) by 348 days.

(21) Appl. No.: 14/434,351

(22) PCT Filed: Sep. 17, 2013

(86) PCT No.: PCT/EP2013/069240
§ 371 (c)(1),
(2) Date: Apr. 8, 2015

(87) PCT Pub. No.: WO2014/056681
PCT Pub. Date: Apr. 17, 2014

(65) Prior Publication Data

US 2015/0258592 A1 Sep. 17, 2015

(30) Foreign Application Priority Data

Oct. 9, 2012 (DE) ..... 10 2012 218 353

(51) Int. Cl.
*B21B 1/46* (2006.01)
*B21B 37/16* (2006.01)
(Continued)

(52) U.S. Cl.
CPC ..... *B21B 37/16* (2013.01); *B21B 1/463* (2013.01); *B21B 13/22* (2013.01); *B21B 31/16* (2013.01);
(Continued)

(58) Field of Classification Search
CPC ..... B21B 37/22; B21B 37/48; B21B 37/52; B21B 2261/06; B21B 2261/05; B21B 2267/18; B21B 2267/19
(Continued)

(56) References Cited

U.S. PATENT DOCUMENTS 3,841,124 A 10/1974 Shida et al.
4,063,076 A * 12/1977 Morooka ..... B21B 1/04 700/153
(Continued)

FOREIGN PATENT DOCUMENTS

DE 2249366 A1 4/1973
DE 3843730 C2 6/1995
(Continued)

OTHER PUBLICATIONS

Decision of Grant dated Jan. 24, 2017 in corresponding Ukraine Patent Application No. A 2015 03295 (total 13 pages).
(Continued)

*Primary Examiner* — Jason L Vaughan
(74) *Attorney, Agent, or Firm* — Ostrolenk Faber LLP

(57) ABSTRACT

A method for altering the width of a strip-shaped rolled material (5), before, during or after hot rolling the rolled material in a hot rolling mill. The problem is to specify a method for altering width so that the length of a rolled out transition piece lying outside width tolerances can be reduced. Scrap losses are to be reduced. The crown of at least one working roll and/or at least one backing roll of a stand (7) is set as a function of a width error e=B−B between a setpoint width $B_{setp}$ and the width B of the rolled material (5), wherein the crown is increased when e>0 and the crown is reduced when e<0. AA $R_{crown}$ BB $B_{setp}$.

16 Claims, 5 Drawing Sheets

(51) Int. Cl.

| | |
|---|---|
| ***B21B 13/22*** | (2006.01) |
| ***B21B 31/16*** | (2006.01) |
| ***B22D 11/12*** | (2006.01) |
| *B21B 37/28* | (2006.01) |

(52) U.S. Cl.
CPC ..... *B22D 11/1206* (2013.01); *B21B 1/46* (2013.01); *B21B 37/28* (2013.01); *B21B 2267/18* (2013.01)

(58) Field of Classification Search
USPC ..... 72/9.1, 11.7, 183
See application file for complete search history.

(56) References Cited

U.S. PATENT DOCUMENTS

| | | | | | |
|---|---|---|---|---|---|
| 4,528,830 | A * | 7/1985 | Masui | B21D 7/02 | 72/11.7 |
| 4,651,550 | A | 3/1987 | Nihei et al. | | |
| 4,711,109 | A * | 12/1987 | Rohde | B21B 37/28 | 72/11.7 |
| 4,846,254 | A * | 7/1989 | Kimura | B21B 1/463 | 164/154.3 |
| 4,881,396 | A * | 11/1989 | Seidel | B21B 13/142 | 492/1 |
| 4,912,956 | A * | 4/1990 | Matricon | B21B 37/36 | 72/11.7 |
| 5,680,784 | A * | 10/1997 | Tateno | G05B 13/027 | 72/11.7 |
| 6,227,021 | B1 * | 5/2001 | Imanari | B21B 37/22 | 72/11.4 |
| 7,181,822 | B2 * | 2/2007 | Ondrovic | B21B 37/32 | 164/476 |
| 7,185,519 | B2 * | 3/2007 | Clark | B21B 37/28 | 72/11.7 |
| 7,823,428 | B1 * | 11/2010 | Malik | B21B 37/28 | 72/7.1 |
| 8,676,371 | B2 * | 3/2014 | Botta | B21B 37/48 | 242/418 |
| 2007/0193322 | A1 * | 8/2007 | Beck | B21B 37/28 | 72/11.7 |

FOREIGN PATENT DOCUMENTS

| | | | |
|---|---|---|---|
| DE | 19844305 | A1 | 3/2000 |
| DE | 60307496 | T2 | 8/2007 |
| EP | 0294807 | A2 | 12/1988 |
| JP | S60206503 | A | 10/1985 |
| JP | H01258807 | A | 10/1989 |
| UA | 90753 | C2 | 5/2010 |

OTHER PUBLICATIONS

Office Action dated Dec. 2, 2015 in corresponding Chinese Patent Application No. 201380052879.8 and Search Report with English language translation (14 total pages).

Lian Jiachuang, et al., "Study of Spread Amount of Rolled Piece," Research on the Lateral Spread of Rolled Stock, Iron and Steel, vol. 19, Issue 11, Nov. 30, 1984 (12 total pages).

International Search Report dated Mar. 7, 2014 issued in corresponding International patent application No. PCT/EP2013/069240.

Written Opinion dated Mar. 7, 2014 issued in corresponding International patent application No. PCT/EP2013/069240.

German Search Report dated Sep. 10, 2013 issued in corresponding German application No. 10 2012 218 353.1.

* cited by examiner

WIDTH-ALTERING SYSTEM FOR STRIP-SHAPED ROLLING ROCK

CROSS-REFERENCE TO RELATED APPLICATIONS

The present application is a 35 U.S.C. §§371 national phase conversion of PCT/EP2013/069240, filed Sep. 17, 2013, which claims priority of German Patent Application No. 10 2012 218 353.1, filed Oct. 9, 2012, the contents of which are incorporated by reference herein. The PCT International Application was published in the German language.

FIELD OF TECHNOLOGY

The present invention relates to a method for altering the width of a strip-shaped rolling stock, in particular before, during or after hot rolling the rolling stock in a hot rolling mill.

TECHNICAL BACKGROUND

In hot rolling, a metallic rolling stock, e.g. a strip-shaped rolling stock made from steel or aluminum, undergoes hot forming in a roll gap of a rolling stand while the material is in a plastic state.

The invention relates to a method for altering the width of a strip-shaped rolling stock, so that the rolling stock passes uncut through a first unit and a second unit, the method comprises the steps:

- producing the rolling stock with a first width $B_1$, wherein the rolling stock emerges from the first unit with a width $B=B_1$, and the emerging rolling stock is transported in a transport direction to the second unit, while maintaining a tension $\sigma=\sigma_{normal}$ on the material;
- producing a transition piece of the rolling stock, wherein the rolling stock emerges from the first unit with the width B, where $B_1 \leq B \leq B_2$;
- producing the rolling stock with a second width $B_2$, wherein the rolling stock emerges from the first unit with the width $B=B_2$.

The invention further relates to a method for altering the width of a strip-shaped rolling stock, wherein the rolling stock passes uncut through a first unit and a second unit, and the rolling stock is rolled in a rolling stand in the first unit and/or in the second unit, comprising the method steps:

- producing the rolling stock with a first width $B_1$, wherein the rolling stock emerges from the first unit with a width $B=B_1$, and the emerging rolling stock is transported to the second unit;
- producing a transition piece of the rolling stock, wherein the rolling stock emerges from the first unit with the width B, where $B_1 \leq B \leq B_2$;
- producing the rolling stock with a second width $B_2$, wherein the rolling stock emerges from the first unit with the width $B=B_2$.

PRIOR ART

It is known from the prior art that the width of a continuously produced slab of metal can be changed in a continuous casting machine by laterally adjusting at least one narrow side wall in the mold. Also known from the prior art is the inline coupling of a continuous casting machine and a hot rolling mill, such that a cut or uncut continuous slab which is produced in the continuous casting machine can be hot rolled directly by the hot rolling mill. Such a coupling of a casting machine with a hot rolling mill is known as a combined casting and rolling plant or Thin Slab Casting and Rolling Plant (TSCR). The uncut and directly coupled operation of the thin slab casting and rolling plant is known as endless operation. The Arvedi ESP (Endless Strip Production) plant is one example of a thin slab casting and rolling plant which offers extremely effective endless operation.

Also known from the prior art is the use of a thin slab casting and rolling plant to produce a rolling stock with varying width. In this case, the width of the continuous slab is typically changed in the mold, thereby producing a tapering or widening slab piece (also known as a transition piece or wedge-shaped transition piece) having a specific length (depending on the casting speed and the traverse rate of the narrow side wall). The continuous slab including the transition piece is then rolled out in the rolling mill of the combined plant, thereby producing a rolled strip which slowly tapers or widens in each case.

Since the strip which slowly changes width cannot normally satisfy width tolerances, it is disadvantageous that the strip including the rolled out transition piece cannot be sold immediately. It is therefore desirable to keep the length of the transition piece as short as possible. This can be achieved either by cutting out the transition piece from the slab or from the rolled out strip, although this inevitably results in considerable scrap losses. Otherwise, the transition piece can be trimmed or edged, thereby reducing the scrap losses to an extent. Very rapid adjustment of the narrow side walls in the mold is likewise excluded, since this can easily result in fractures in the thin strand shell of the continuous slab.

Means by which the scrap losses can be further reduced while maintaining a high level of operational reliability are not indicated in the prior art.

SUMMARY OF THE INVENTION

The object of the invention is to overcome the disadvantages of the prior art and to provide a method for altering the width of a strip-shaped rolling stock. The method makes it possible to reduce the length of a rolled out transition piece that exceeds the width tolerances. This method is intended thereby to reduce the scrap losses.

This object may be achieved by a method for altering the width of a strip-shaped rolling stock, wherein the rolling stock passes uncut through a first unit and a second unit, comprising method steps:

- producing the rolling stock with a first width $B_1$, wherein the rolling stock emerges from the first unit with a width $B=B_1$, and the emerging rolling stock is transported in the transport direction to the second unit while maintaining a tension $\sigma=\sigma_{normal}$ on the material;
- producing a transition piece of the rolling stock, wherein the rolling stock emerges from the first unit with the width B, where $B_1 \leq B \leq B_2$;
- producing the rolling stock with a second width $B_2$, wherein the rolling stock emerges from the first unit with the width $B=B_2$.

The object is achieved by setting the tension $\sigma$ on the rolling stock between the first unit and the second unit as a function of a width error $e=B_{setp}-B$ between a setpoint width $B_{setp}$ and the width B of the rolling stock, wherein the tension $\sigma$ is increased to $\sigma>\sigma_{normal}$ if $e<0$.

According to the invention, a width error e between a setpoint width $B_{setp}$ and the width B of the rolling stock is calculated and the tension $\sigma$ on the rolling stock between the first and the second unit is set as a function of the width error e. In the case of a negative width error e, the tension σ is increased to $\sigma>\sigma_{normal}$ whereby the width of the rolling stock emerging from the second unit is reduced. This principle is based on the finding that not only an increase in length (elongation) but also an increase in width (lateral flow) usually occurs when a strip is rolled. If the strip is under tension, however, the width increase is less or even negative. It is noted in this context that the cited principle is by no means limited to rolling mills, but can be applied to any directly coupled units. It need merely be ensured that the tension on the rolling stock between the two units can be set.

The increase of the tension σ can be effected e.g. by increasing the driving torque of the second unit which follows the first unit in the direction of transport. Alternatively or additionally, the driving torque of the first unit can be reduced. This can be effected e.g. by the drive motors in a rolling stand or in a pair of drive rollers.

For increasing the width of the rolling stock, it is advantageous to reduce the tension σ to $\sigma<\sigma_{normal}$ in the event of a positive width error e. In absolute terms, the tension σ can even assume negative values in this context, i.e. such that the normal stress in the direction of transport is a compressive stress.

The reduction of the tension σ can be effected e.g. by reducing the driving torque of the second unit. Alternatively or additionally, the driving torque of the first unit can be increased. This can be effected e.g. by the drive motors in a rolling stand or in a pair of drive rollers. It is therefore also possible to compensate for positive width errors at least partially, preferably completely, by means of the inventive method. It is noted in this context that although the width of a strip can be altered by the use of loopers between two rolling stands, this cannot be applied to positive width errors due to the nature of the system.

For example, the first and second units may be a casting machine and a roughing mill train, a roughing mill train and a finishing mill train, or generally the region between two drive rollers, wherein at least the driving torque of one drive roller must be independently settable in order to apply a tension to the strip between the drive rollers. It is naturally also possible for the two units to be two consecutive rolling stands of the same mill train.

The setting of the tension σ as a function of the width error e can be effected in either a controlled or regulated manner, i.e. on the basis of the measured width $B_{actual}$ of the rolling stock as it emerges from or after it has emerged from the second unit. The regulated setting has the advantage that the actual width of the rolling stock or rolled product takes other influences into consideration after the rolling of the rolling stock (e.g. the temperature of the hot strip).

According to a particularly advantageous embodiment, the setting of the tension σ (which can also have a negative operational sign and therefore be a pressure) is effected on the basis of a mathematical necking model for the rolling stock. This model advantageously takes into consideration the deformation resistance, which is dependent on profiles for degree of deformation, deformation rate and temperature, the current structural state, the creep behavior, which is dependent on the current state of the rolling stock, the chemical composition of the rolling stock, the temperature of the rolling stock, and possibly a temperature-dependent elasticity modulus of the rolling stock.

According to a particularly effective embodiment, the first or the second unit is a rolling stand and the rolling stock is rolled in the rolling stand. In this way, the tension on the rolling stock can easily be set by means of higher or lower rolling torques without any requirement for additional equipment costs.

This object of the invention is likewise achieved by a method for altering the width of a strip-shaped rolling stock, wherein the rolling stock passes uncut through a first unit and a second unit and the rolling stock is rolled in a rolling stand in the first unit and/or in the second unit, comprising method steps:

- producing the rolling stock with a first width $B_1$, wherein the rolling stock emerges from the first unit with a width $B=B_1$, and the emerging rolling stock is transported to the second unit;
- producing a transition piece of the rolling stock, wherein the rolling stock emerges from the first unit with the width B, where $B_1 \leq B \leq B_2$;
- producing the rolling stock with a second width $B_2$, wherein the rolling stock emerges from the first unit with the width $B=B_2$.

The object to be achieved is that the crown of at least one working roll and/or at least one backing roll of the rolling stand is set as a function of a width error $e=B_{setp}-B$ between a setpoint width $B_{setp}$ and the width B of the rolling stock, wherein the crown is increased if $e>0$ and the crown is reduced if $e<0$.

If the first and/or second unit is a rolling stand, in addition to or as an alternative to altering the tension of the rolling stock, the crown of a working roll or backing roll of the rolling stand can be set as a function of the width error e, wherein the crown of the roll is increased if $e>0$ and the crown of the roll is reduced if $e<0$. In this context, crown is understood to signify the central crown, wherein the thickness of the rolling stock in a central region is reduced as a result of increasing the crown, such that the lateral flow of the rolling stock is increased during rolling. Conversely, the central crown is reduced in the case of a negative width error e, such that the lateral flow is reduced during rolling. The setting of the crown of a roll can be effected, for example, by means of roll bending actuators and/or by means of thermal alteration (e.g. zone-specific cooling) of the roll. If it is desired to increase the crown by means of thermal alteration, the cooling in the edge regions of the roll is increased to a greater extent than in the central regions. The central region of the roll therefore expands to a greater extent than the edge regions, thereby raising the crown. Conversely, the crown is reduced if the cooling in the central region of the roll is increased to a greater extent than in the edge regions.

In order to ensure that the geometry of the rolling stock is not changed excessively as a result of setting the crown for the purpose of altering the width, provision is advantageously made for both units to comprise a rolling stand, and for a modification of the crown of a roll to take place primarily in the first unit. This ensures that the rolled product has a desired geometry after rolling in the second unit.

The setting of the crown as a function of the width error e can also be effected in either a controlled or regulated manner, i.e. on the basis of the measured width $B_{actual}$ of the rolling stock, e.g. as it emerges from the second unit or subsequently at an additional location.

When setting the crown in particular, it is very advantageous to take into consideration the transport time of the rolling stock from the first unit and/or from a measuring device for capturing the actual width $B_{actual}$ to the rolling stand. It is then possible to compensate for the width of the transition piece in the rolling stand of the second unit at the correct time. However, the transport time can also be taken into consideration when setting the tension for the purpose of altering the width.

Since only strips having a specific width can usually be sold, the setpoint width $B_{setp}$ is advantageously a step function H(t) from $B_1$ to $B_2$ or from $B_2$ to $B_1$. Alternatively the setpoint width $B_{setp}$ can also be a ramp function R(t) from $B_1$ to $B_2$ or from $B_2$ to $B_1$. Other functions are obviously also possible.

It is generally appropriate for the first unit to be a mold of a casting machine, e.g. a bow-type continuous casting machine or two-roll casting machine, or a rolling stand, e.g. a rolling stand of a roughing mill train.

In the context of hot rolling in a hot rolling mill in particular, it is appropriate to transport the rolling stock from the first unit on a roller table to the second unit. However, the invention is by no means limited to this, and also functions for loops hanging freely between two units, for example.

BRIEF DESCRIPTION OF THE DRAWINGS

Further advantages and features of the present invention are derived from the following description of non-restrictive exemplary embodiments, wherein reference is made to the following figures, in which.

DESCRIPTION OF THE EMBODIMENT VARIANTS

Figure 1:
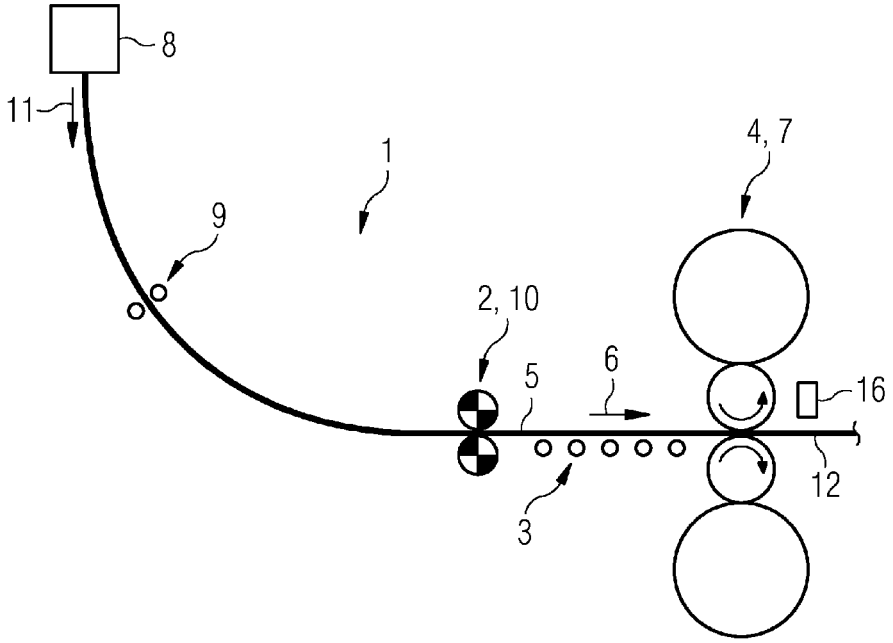
FIGS. 1 and 8 each show a schematic illustration of part of a thin slab casting and rolling plant, wherein the purpose of the part is to effect an alteration of the width of a strip-shaped rolling stock between a continuous casting machine and a roughing mill.

FIG. 1 shows part of a thin slab casting and rolling plant comprising a bow-type continuous casting machine 1 for continuously casting steel melt into thin slabs, and a subsequent in-line mill train. Of the mill train, only one rolling stand 7 of the roughing mill train is illustrated; other parts of the plant are not illustrated. In the mold 8, liquid steel is continuously cast into a thin slab strand, wherein the width of the strand is initially $B=B_1=1800$ mm and its thickness is initially 90 mm. The casting speed 11 is 5 m/min. The metallurgical length of the continuous casting machine 1 from the mold 8 to the two drive rollers 10 is 15 m. Downstream from the mold 8, the thin slab strand is supported in the strand guide 9, guided and cooled further, wherein the strand solidifies in the final third of the curved strand guide 9. The strand guide 9 is indicated by two strand guide rollers. The solidified thin slab strand emerges from the continuous casting machine 1 via the drive rollers 10 and represents the rolling stock 5. The pair of drive rollers 10 forms the first unit 2. The rolling stock 5 is guided uncut in the direction of transport 6 from the first unit 2 via the roller table 3 to the second unit 4. The second unit 4 takes the form of a rolling stand 7 of the roughing mill train. The rolling stock 5 which has been rolled in the rolling stand is also referred to as the rolled product 12.

If a different width of the rolled product 12 is now desired, the two narrow side plates of the mold 8 are moved transversely to the direction of casting. For example, the two narrow side plates are moved during the uninterrupted operation of the thin slab casting and rolling plant at a traverse rate of 50 mm/min from $B_1=1800$ mm to $B_2=1850$ mm. As a result of this traversing movement, a wedge-shaped thin slab strand (also known as a transition piece) of changing width forms in the strand guide 9 downstream of the mold 8. The width $B_{mold}$ of the thin slab strand as it emerges from the mold 8 and of the rolling stock 5 as it emerges from the first unit 2 $B_{driveroller}$ are illustrated as a continuous line in FIG. 2. Depending on the length of the continuous casting machine, the head of the transition piece emerges from the first unit 2 after a delay of 3 min from leaving the mold 8.

Concerning the width adjustment in the mold, it is noted that when producing thin slabs, the narrow sides of the mold are usually slowly inclined at the beginning of the transition piece. The inclined plates are then moved, and finally the inclined plates are returned to their original gradient. This has the advantage that the strand is better supported by the mold walls. The widths $B_{mold}$ and $B_{driveroller}$ according to this procedure are illustrated by means of dash-dot lines in FIG. 2.

Figure 2:
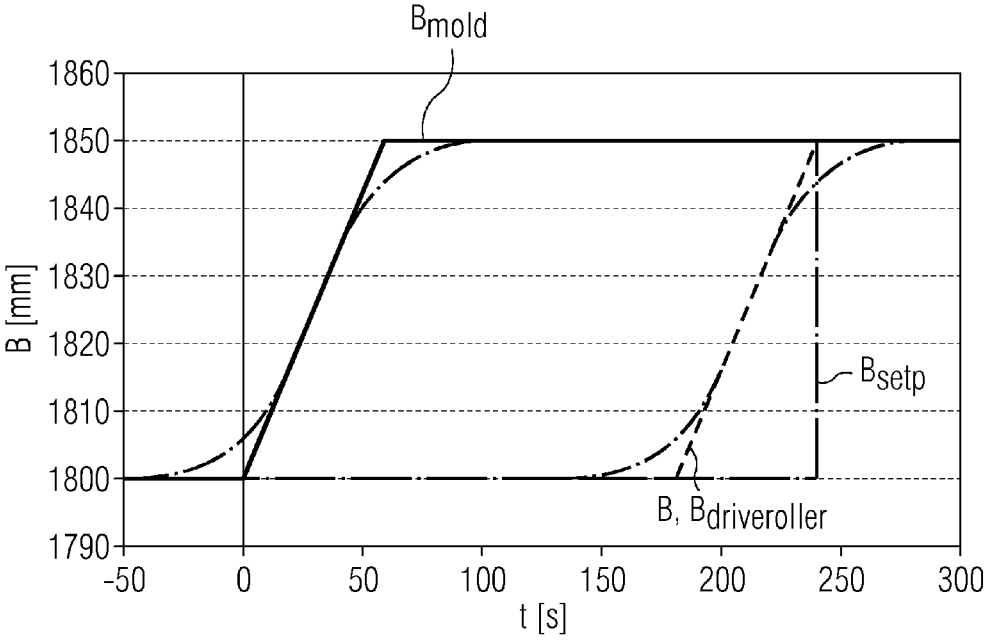
FIGS. 2 and 5 each show an illustration of the width $B_{mold}$ of the rolling stock at the mold, the width $B_{driveroller}$ at the drive roller, and the setpoint width $B_{setp}$ at the position of the drive roller relative to time for the embodiment variant according to FIG. 1.

Also illustrated in FIG. 2 is the setpoint width $B_{setp}$ of the rolling stock 5, wherein the setpoint width can be expressed mathematically as $B_{setp}=1800+50.H(240)$, wherein the Heaviside step function H(t) steps from zero to one at 240 s. For example, the step function is known from http://mathworld.wolfram.com/HeavisideStepFunction.html.

The principle of the invention is therefore based on changing the tension on the rolling stock 5 between the first unit 2 (specifically the pair of drive rollers 10) and the second unit 4 (the rolling stand 7 of the roughing mill train) as a function of the width error e, where $e=B_{setp}-B$, wherein the tension $\sigma$ on the rolling stock 5 is increased in the direction of transport 6 if e is negative. This means that the tension results in necking of the rolling stock 5, thereby reducing the width of the rolling stock 5 or rolled product 12.

Figure 3:
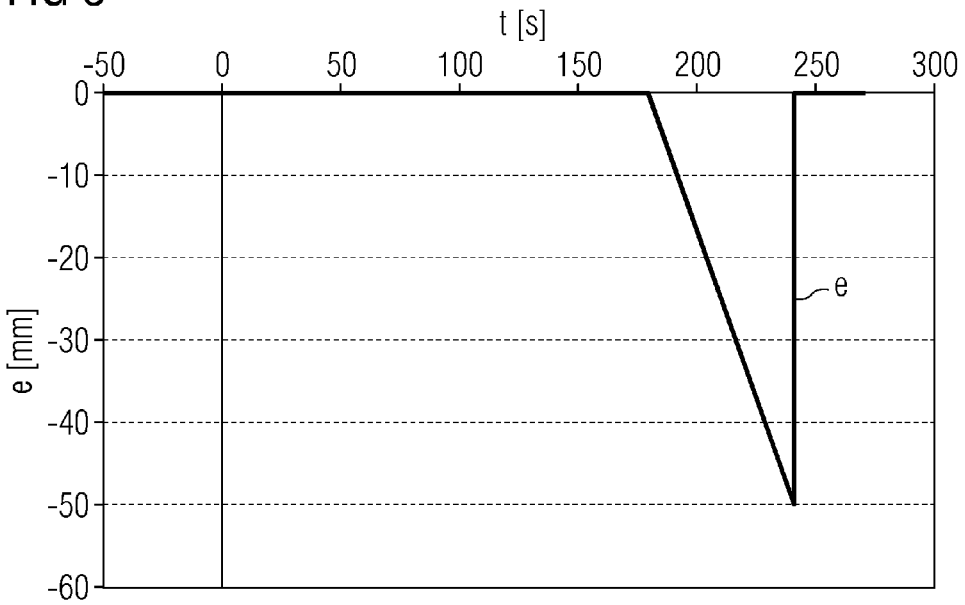
FIGS. 3 and 6 each show an illustration of the width error e relative to time at the position of the drive roller for the embodiment variant according to FIG. 1.

The width error e is illustrated in FIG. 3. The width error e for the widths as marked by dash-dot lines in FIG. 2 is not shown here.

Figure 4A:
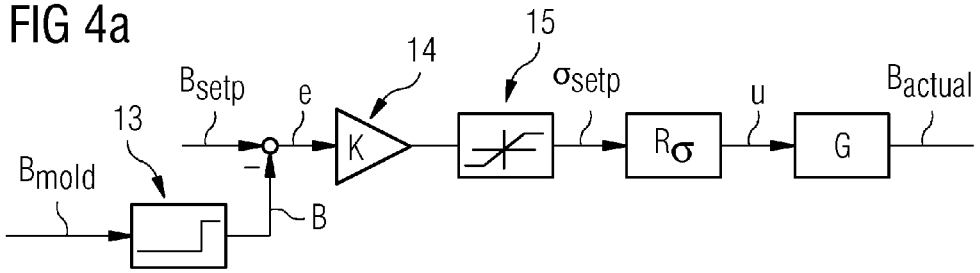
FIG. 4*a* shows a control model for performing the method according to the invention.

A control model for implementing the method according to the invention is illustrated in FIG. 4*a*. Specifically, the width error e is determined by the difference between the setpoint value for the width $B_{setp}$ and the width B, where B is determined from the width of the thin slab strand at the exit of the mold 8 by the dead time element, taking into consideration a dead time of 3 min. The width error is then amplified by an amplifier element 14 and held within permitted minimal and maximal limit values by the limiter element 15. The result $\sigma_{setp}$ is supplied to a tension regulator $R_\sigma$ for the rolling stand 7, which sets the tension $\sigma$ on the rolling stock 5 accordingly. The correcting variable u is applied to the regulated section G, wherein the regulated section G delivers output in the form of an actual width $B_{actual}$ of the rolled product 12 as it emerges from the second unit 4.

Figure 4B:
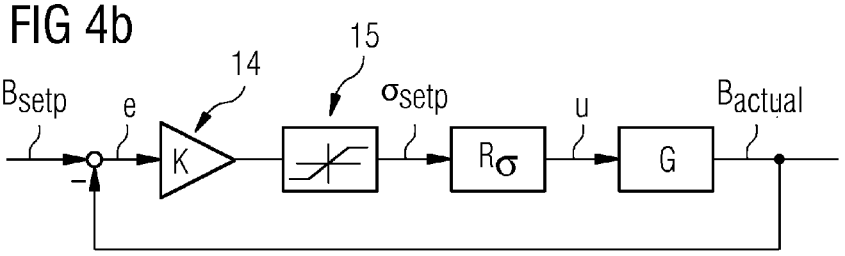
FIGS. 4*b*, 7 and 10 each show a regulating model for performing the method according to the invention.

The essential difference between the control model in FIG. 4*a* and the regulating model in FIG. 4*b* is that the actual width $B_{actual}$ of the rolled product 12 is measured by the width measuring device 16 immediately after it emerges from the second unit 4 (see FIG. 1), and is fed back to the regulating circuit such that the accuracy of the width alteration can be significantly increased.

Figure 5:
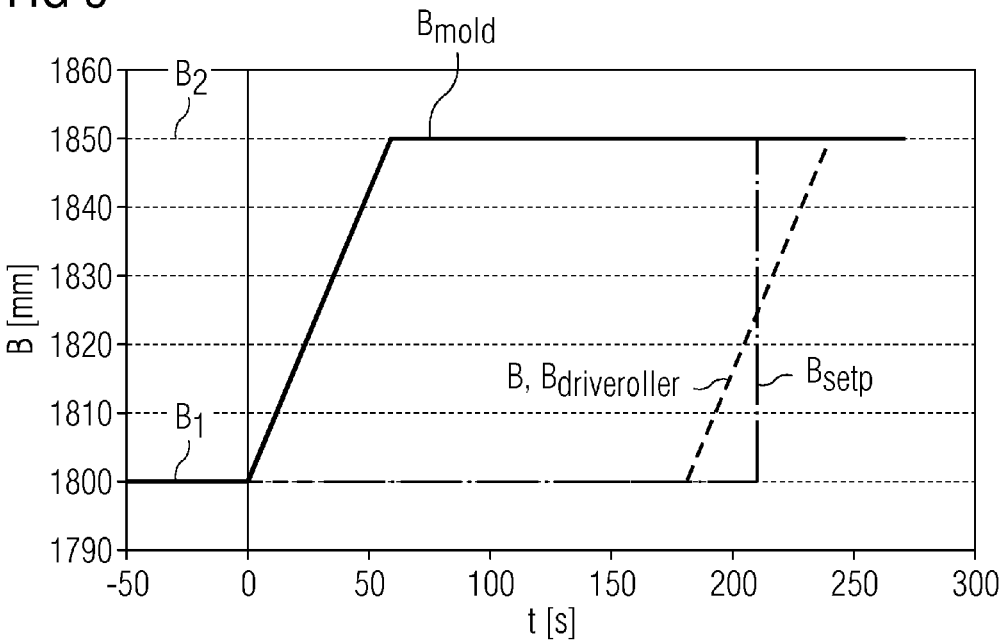
Figure 6:
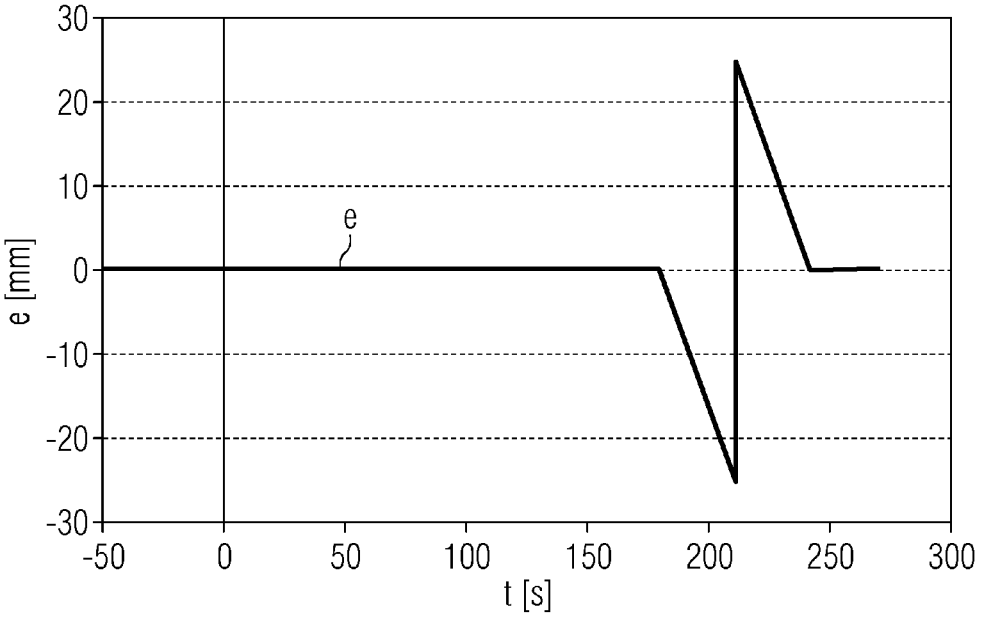

It is obviously also possible to select another function for the setpoint width $B_{setp}$, e.g. as per FIG. 5. However, using identical width values B, such a selection results in positive and negative values for the width error e, and therefore the control process as per FIG. 4*a* or the regulating process as per FIG. 4*b* compresses the rolling stock 5 if e has a positive value. This compression causes the width of the rolling stock 5 to increase.

In any case, the method according to the invention ensures that the actual width $B_{actual}$ of the rolled product 12 is kept closer to the setpoint width $B_{setp}$ and therefore the width tolerances can be better satisfied.

Figure 7:
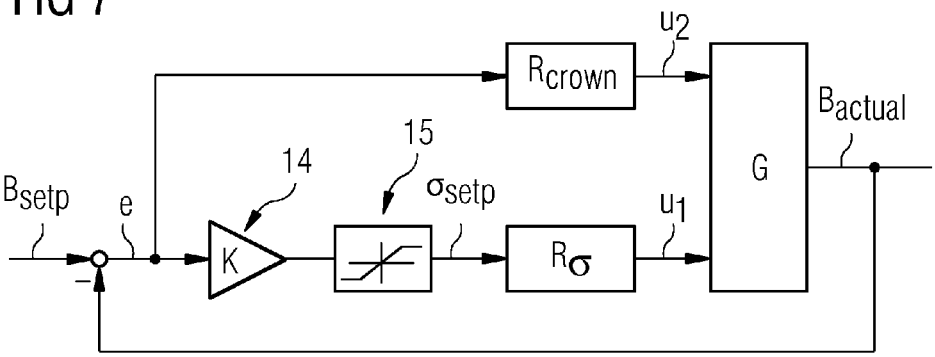

In addition to altering the tension σ for the purpose of altering the width of the rolling stock 5, it is also possible to set the crown of a working and/or a backing roll of the rolling stand 7 as a function of the width error e. In order to achieve this, use is made of e.g. the regulating model according to FIG. 7. This differs from the model according to FIG. 4*b* in that the width error e is also supplied to a regulator $R_{crown}$ for altering the crown of a working and/or backing roll of the rolling stand 7, the crown of the roll being altered by means of the correcting variable $u_2$. This means that the regulated section G is altered by two correcting variables $u_1$, $u_2$, the regulated variable being the width $B_{actual}$ of the rolling stock 5 after the second unit 4 (specifically the rolling stand 7). The correcting variable $u_1$ corresponds to the correcting variable u from FIG. 4*b*. As is evident from FIG. 1, the actual width $B_{actual}$ can be measured by the width measuring device 16 at the exit of the second unit 4 and supplied to the regulating loop.

Figure 8:
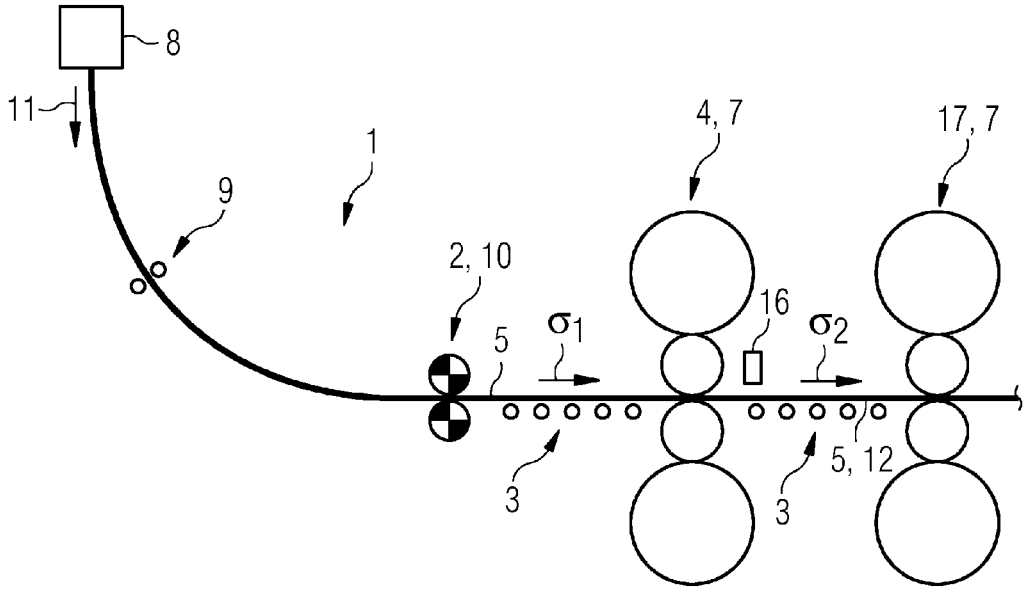
Figure 9:
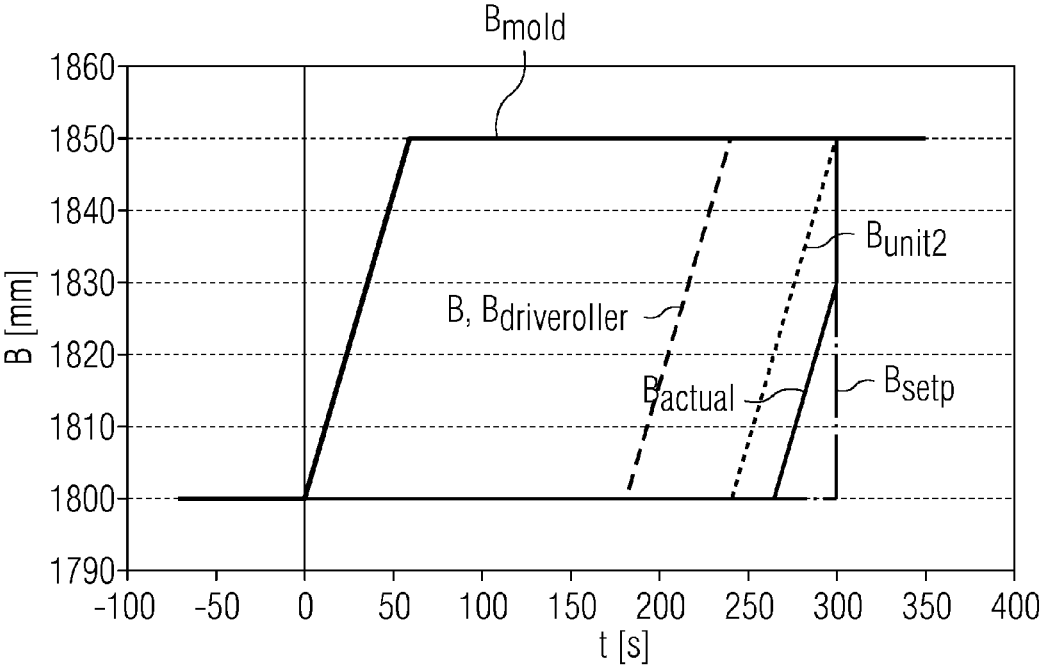
FIG. 9 shows an illustration of different widths relative to time for the embodiment variant according to FIG. 8.

Like FIG. 1, FIG. 8 shows a part of a thin slab casting and rolling plant comprising a continuous casting machine 1, a first unit 2 in the form of a pair of drive rollers 10, a second unit 4 in the form of a rolling stand 7, and additionally a third unit 17 in the form of a further rolling stand 7. In order to achieve greater drawing and/or retaining forces, the first unit 2 could obviously also comprise a plurality of drive rollers 10. The second unit 4 and the third unit 17 together form the roughing mill train of the thin slab casting and rolling plant. In FIG. 8, the rolling stock 5 is extracted from the continuous casting machine 1 with a thickness of 90 mm by the drive rollers 10, then rolled to a thickness of 50 mm in the second unit 4, and finally reduced to a thickness of 30 mm in the third unit 17. FIG. 9 shows the width of the strand after the mold 8 $B_{mold}$, the width of the strand at the drive roller 10 $B_{driveroller}$, the setpoint width $B_{setp}$, and the width of the strand after it has emerged from the second unit 4, once without application $B_{unit2}$ and once with application $B_{actual}$ of the method according to the invention. The actual width of the rolling stock 5 or rolled product 12 is again measured by the width measuring device 16 immediately after the second unit 4. It is evident from FIG. 9 that the actual width $B_{actual}$ of the rolled product 12 remains within the width tolerance for a considerably longer time when the method is applied, thereby reducing the scrap losses.

Figure 10:
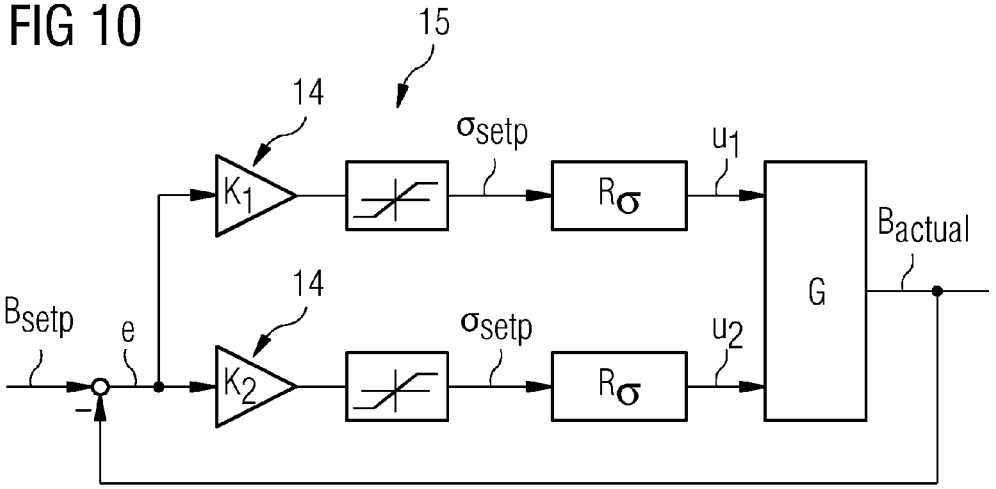

The regulating model relating to FIGS. 8 and 9 is shown in FIG. 10. Unlike the regulating model according to FIG. 4*b*, the width error $e=B_{setp}\ B_{actual}$ is used to regulate a first tension $\sigma_1$ between the first unit 2 and the second unit 4 and to regulate a second tension $\sigma_2$ between the second unit 4 and the third unit 17, wherein the resulting correcting variables $u_1$, $u_2$ act together on the regulated section G. If applicable, it is possible to select different amplification factors $K_1$ and $K_2$ of the amplifier elements 14, limitations of the limiter elements 15, and regulators Re in the first branch for altering the tension $\sigma_1$ and in the second branch for altering the tension $\sigma_2$.

Although the invention has been illustrated and described in detail by the preferred exemplary embodiments, it is not restricted by the examples disclosed therein, and other variations can be derived therefrom by the person skilled in the art, without departing from the scope of the invention.

LIST OF REFERENCE CHARACTERS

1 Continuous casting machine
2 First unit
3 Roller table
4 Second unit
5 Rolling stock
6 Transport direction
7 Rolling stand
8 Mold
9 Strand guide
10 Drive roller
11 Casting speed
12 Rolled product
13 Dead time element
14 Amplifier element
15 Limiter element
16 Width measuring device
17 Third unit
B Width
$B_{actual}$ Actual width
$B_{setp}$ Setpoint width
$B_{mold}$ Width of the strand emerging from the mold
$B_{driveroller}$ Width of the rolling stock emerging from the first unit
$B_{unit2}$ Width of the rolling stock emerging from the second unit
$B_1$ First width
$B_2$ Second width
e Width error
G Regulated section
R Regulator
$R_\sigma$ Tension regulator
σ Tension
t Time
$u, u_1, u_2$ Correcting variable

The invention claimed is:

1. A method for altering the width of a strip-shaped rolled material rolling stock comprising:

passing the rolling stock uncut through a first unit and then through a second unit, wherein rolling of the rolling stock is performed in a rolling stand in at least one of the first unit and the second unit, and further comprising method steps of:

producing the material rolling stock with a first width $B_1$, wherein the rolling stock emerges from the first unit with a width $B=B_1$, and then transporting the rolling stock downstream to the second unit;

producing a transition piece in the rolling stock, wherein the transition piece is produced upstream of the portion of the rolling stock having the width $B_1$, wherein the rolling stock emerges from the first unit including the transition piece and wherein the transition piece is a wedge-shaped piece of changing width and includes a changing width different from that of $B_1$;

producing the rolling stock with a second width $B=B_2$, the second width being located upstream of the transition piece, wherein the rolling stock emerges from the first unit with the width $B_2$ and wherein $B_2$ is a width greater or lesser than $B_1$; and setting a crown of at least one working roll and/or at least one backing roll of the rolling stand as a function of a width error $e=B_{setp}-B$, that is between a setpoint width $B_{setp}$ and the width B of the rolling stock, wherein the crown of the at least one working roll or backing roll is increased if $e>0$ and wherein the crown of the at least one working roll or backing roll is reduced if $e<0$.

2. The method as claimed in claim 1, further comprising the setting of the crown is in a controlled manner as a function of the width error e.

3. The method as claimed in claim 1, further comprising the setting of the crown in a regulated manner as a function of the width error e, wherein the width B is the measured width $B_{actual}$ of the rolling stock as the rolling stock emerges from the second unit or after the material emerges.

4. The method as claimed in claim 1, further comprising the setting of the crown takes into consideration the transport time of the rolling stock from the first unit to the rolling stand.

5. The method as claimed in claim 1, wherein the setpoint width $B_{setp}$ is either a step function H(t) or a ramp function R(t) from $B_1$ to $B_2$ or from $B_2$ to $B_1$.

6. The method as claimed in claim 1, wherein the first unit is a mold of a casting machine.

7. The method as claimed in claim 6, wherein the casting machine is a bow-type continuous casting machine.

8. The method as claimed in claim 6, wherein the casting machine is a rolling stand of the roughing mill train.

9. The method as claimed in claim 1, wherein the first unit is a rolling stand.

10. The method as claimed in claim 9, wherein the first unit is a rolling stand of a roughing mill train.

11. The method as claimed in claim 1, further comprising the transporting of the rolling stock from the first unit to the second unit is on a roller table.

12. The method as claimed in claim 1, further comprising the transporting of the rolling stock emerging from the first unit is in the direction of transport to the second unit while maintaining a tension $\sigma=\sigma normal$; and setting the tension $\sigma$ on the rolling stock between the first unit and the second unit as a function of the width error $e=B_{setp}-B$, and increasing the tension $\sigma$ to $\sigma>\sigma normal$ if $e<0$.

13. The method as claimed in claim 12, further comprising reducing the tension $\sigma$ to $\sigma<\sigma normal$ if $e>0$.

14. The method as claimed in claim 13, further comprising the setting the tension $\sigma$ in a controlled manner as a function of the width error e.

15. The method as claimed in claim 13, further comprising the setting of the tension $\sigma$ in a regulated manner as a function of the width error e, wherein the width B is a measured width $B_{actual}$ of the rolling stock as it emerges from the second unit.

16. The method as claimed in claim 12, further comprising the setting of the tension $\sigma$ on the basis of a mathematical necking model for the rolling stock under tension $\sigma$.

* * * * *